United States Patent [19]

Elliott

[11] Patent Number: 4,869,404

[45] Date of Patent: Sep. 26, 1989

[54] CONDIMENT PUMP

[75] Inventor: James D. Elliott, Cheyenne, Wyo.

[73] Assignee: American Wyott Corporation, Cheyenne, Wyo.

[21] Appl. No.: 124,541

[22] Filed: Nov. 23, 1987

[51] Int. Cl.[4] ..... B67D 5/42

[52] U.S. Cl. ..... 222/385; 222/380; 222/526; 222/568

[58] Field of Search ..... 222/385, 526, 533, 566–568, 222/372, 380, 383, 384; 137/533.11–533.15, 801; 251/297; 239/587, 380

[56] References Cited

U.S. PATENT DOCUMENTS

| | | | |
|---|---|---|---|
| 468,870 | 2/1892 | Griswold | 222/533 |
| 699,421 | 5/1902 | Snyder | 137/533.11 X |
| 1,913,592 | 6/1933 | Heffner . | |
| 2,183,370 | 12/1939 | Selitzky . | |
| 2,205,875 | 6/1940 | Coffey et al. . | |
| 2,639,063 | 5/1953 | Yuza . | |
| 2,756,905 | 7/1956 | Wickesberg . | |
| 2,774,517 | 12/1956 | Teegardin et al. | 222/380 |
| 2,966,861 | 1/1961 | Stewart et al. . | |
| 3,332,585 | 7/1967 | Cox . | |
| 3,425,358 | 2/1969 | Kilborn et al. . | |

FOREIGN PATENT DOCUMENTS

| | | | |
|---|---|---|---|
| 544551 | 9/1922 | France | 222/385 |
| 1095572 | 6/1955 | France | 222/385 |
| 167264 | 6/1934 | Switzerland | 222/385 |

*Primary Examiner*—Joseph J. Rolla
*Assistant Examiner*—Boris Milef
*Attorney, Agent, or Firm*—Herbert J. Hammond

[57] ABSTRACT

A condiment pump having a container and a lid. A cylinder extends downward into the container and contains a piston and a piston rod. A lower ball valve is located near the bottom of the cylinder, and a side arm tube extends from the lower ball valve to the top of the container. An upper ball valve is located at the top of the side arm tube, and a spout extends upward from the side arm tube. A washer plate covers the upper end of the side arm tube and has a eccentric hole and a post. The post extends downward from the washer plate to keep the ball of the upper ball at least a predetermined distance away from the hole. A pin engages one of eight notches in the rim of the washer plate. This allows the washer plate and the spout to be rotated through eight different positions.

9 Claims, 2 Drawing Sheets

CONDIMENT PUMP

BACKGROUND OF THE INVENTION

1. Field of the Invention

This invention relates in general to the field of dispensing devices. In particular, the invention relates to pump dispensers for dispensing condiments, such as mayonnaise, ketchup, mustard, picante sauce, or salad dressing.

2. Background of the Prior Art

Manually operated pump dispensers have been known at least since the days of the corner drugstore, when chocolate syrup was dispensed onto ice cream sundaes. Later, pump dispensers were used to dispense ketchup onto french fries, purchased at a local hamburger shop.

Prior art pump dispensers work well with liquid contents, such as chocolate syrup and ketchup. However, when the substance to be dispensed contains solid chunks, such as picante sauce or bleu cheese dressing, the chunks tend to plug the spouts of the pumps. The prior art pumps also tend to strain out the larger solid chunks.

SUMMARY OF THE INVENTION

The purpose of the condiment pump of the invention is to pump either chunky condiments, such as picante sauce and bleu cheese dressing, or smooth condiments, such as mayonnaise and ketchup. The condiment pump of the invention accomplishes this purpose by means of a washer plate, having an eccentric hole, and covering the upper end of the side arm tube. A post extends downward from the center of the washer plate to keep the ball of the upper ball valve at least a predetermined distance away from the hole. This predetermined distance is large enough to allow the chunks in the condiment to pass through the hole in the washer plate.

The condiment pump of the invention has a cylinder extending downward into a container. A piston rod is connected to a piston within the cylinder, and extends upward above the top of the container. Bias means, such as a helical spring, biases the piston upward.

A lower ball valve is located at the bottom of the cylinder. A side arm tube extends from the lower ball valve to the top of the container. An upper ball valve is located at the top of the side arm tube. A spout extends upward from the upward end of the side arm tube.

The washer plate, covering the upper end of the side arm tube, may have a plurality of notches around the rim of the washer plate. A pin extending upward from the upper ball valve engages one of the notches in the washer plate. The pin holds the washer plate and the spout in a selected position. However, the pin can be easily overcome and the spout can be rotated to another position when desired.

DESCRIPTION OF THE PREFERRED EMBODIMENT

Figure 1:
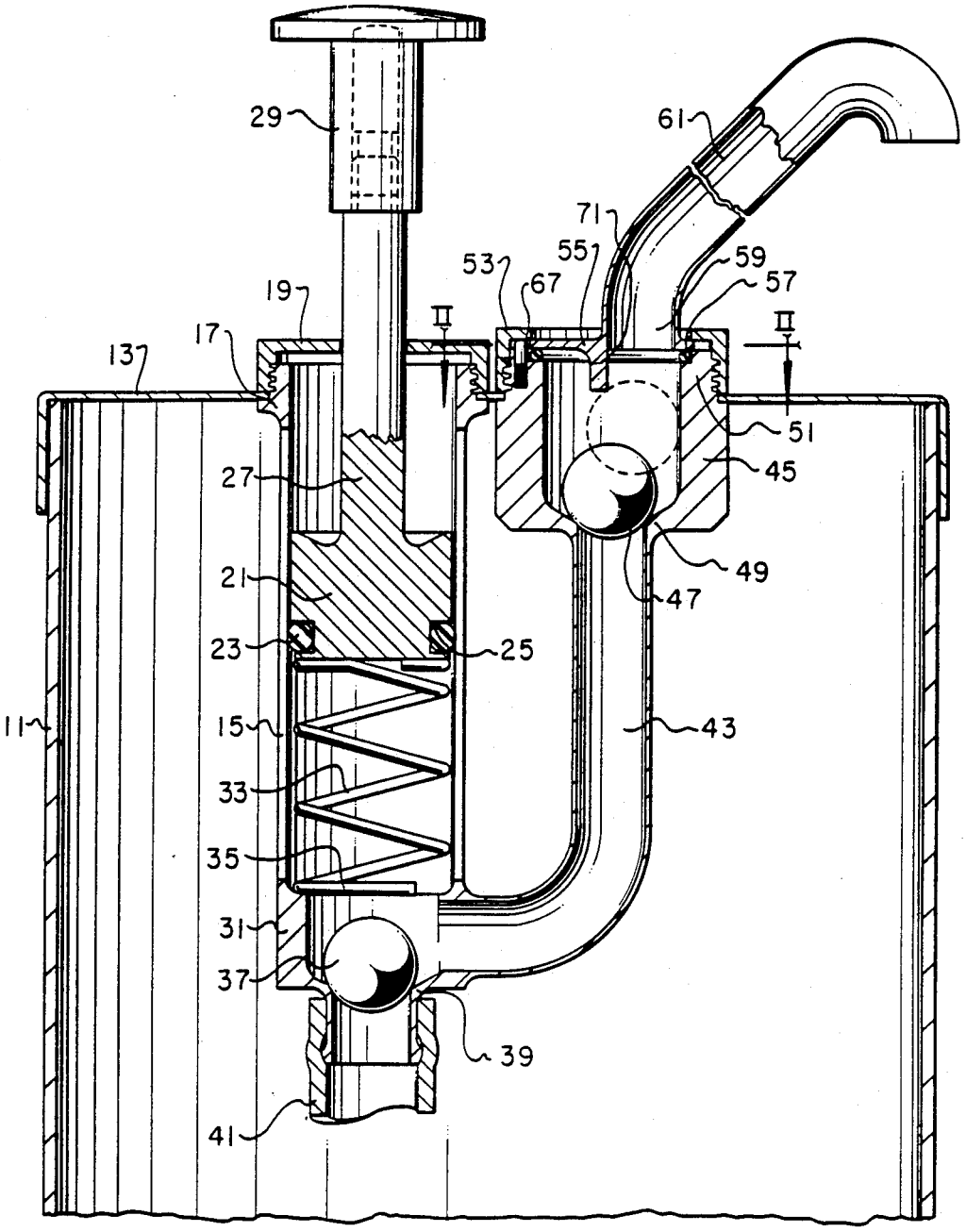
FIG. 1 is a sectional side view of the condiment pump of the invention.

As shown in FIG. 1, the condiment pump of the invention has a container 11, which is usually cylindrical. A lid 13 fits over the top of the container 11.

A cylinder 15 extends downward into the container 11. The threaded upper end 17 of the cylinder 15 extends upward through a hole in the lid 13. A threaded cylinder nut 19 engages the upper end 17 of the cylinder 15 to secure the cylinder 15 to the lid 13.

A piston 21 is located within the cylinder 15. An O-ring seal 23, located within a seal groove 25 on the piston 21, seals between the piston 21 and the interior surface of the cylinder 15.

A piston rod 27 extends upward from the piston 21 through a hole in the cylinder nut 19. A knob 29 on the upper end of the piston rod 27 facilitates manual operation of the piston rod 27.

A lower ball valve 31 is located near the bottom of the cylinder 15. A helical spring 33, between the lower ball valve 31 and the bottom of the piston 21, is a bias means for biasing the piston 21 upward. The lower end 35 of the spring 33 extends through the center of the cylinder 15.

The lower ball valve 31 has a ball 37 and a valve seat 39. When the piston 21 is being moved downward, pressure within the cylinder 15 causes the ball 37 to seal against the valve seat 39. When the piston 21 is being moved upward, the lower pressure within the cylinder 15 causes the ball valve 31 to open, as the ball 37 is moved upward against the lower end 35 of the spring 33. When the lower ball valve 31 is open, condiment from within the container 11 is able to move through the lower ball valve 31.

An extension tube 41 may be attached to the lower end of the lower ball valve 31. The length of the extension tube 41 may be selected according to the depth of the container 11.

A side arm tube 43 extends upward from the lower ball valve 31 to the lid 13 on top of the container 11. An upper ball valve 45 is located on the upper end of the side arm tube 43. The upper ball valve 45 has a ball 47 and a valve seat 49. Upward movement of the piston 21 closes the upper ball valve 45. Downward movement of the piston 21 opens the upper ball valve 45, and allows condiment to flow through the upper ball valve 45. The threaded upper end 51 of the upper ball valve extends through a hole in the lid 13. A threaded spout nut 53 engages the upper end 51 of the upper ball valve 45 to secure the upper ball valve 45 to the lid 13.

A washer plate 55 is secured between the spout nut 53 and the upper end 51 of the upper ball valve 45. An O-ring seal 57 seals between the washer plate 55 and the upper end 51 of the upper ball valve 45. As shown in both FIGS. 1 and 2, the washer plate 55 has an eccentric hole 59, which allows condiment to flow through the washer plate 55. A spout 61 extends upward from the hole 59 in the washer plate 55 to direct the condiment out of the container 11. The spout 61 may be of many different lengths and angles.

Figure 2:
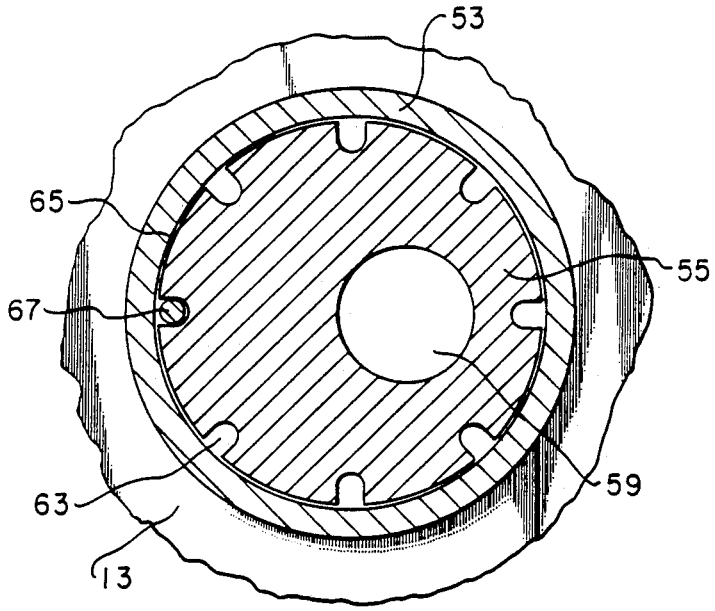
FIG. 2 is a sectional view as seen along lines 2—2 in FIG. 1.

As shown in FIG. 2, the washer plate 55 has eight notches 63, evenly spaced around the rim 65 of the washer plate 55. One of the notches 63 is engaged by a pin 67, which extends upward from the upper end 51 of the upper ball valve 45. The pin 67 holds the washer plate 55 in a predetermined rotatable position. This allows the spout 61 to be located at a selected position.

A post 71 extends downward from the washer plate 55. The post 71 is located adjacent to the hole 59 in the washer plate 55. The post 71 keeps the ball 47 of the upper ball valve 45 at least a predetermined distance away from the hole 59 in the washer plate 55, as shown in shadow in FIG. 1. The eccentricity of the hole 59 in the washer plate 55 and the post 71 combine to keep the ball 47 away from the hole 59. This allows chunky condiments to flow unhindered through the hole 59 in the washer plate 55.

In operation, the container 11 is filled with a condiment. As the piston rod 27 is raised, the lower ball valve 31 is opened and the upper ball valve 45 is closed. Condiment is drawn into the cylinder 15 and the side arm tube 43. As the piston 21 is lowered, the lower ball valve 31 closes and the upper ball valve 45 opens. Condiment is pushed through the upper ball valve 45 into the spout 61. The pin 67 allows the spout 61 and the washer plate 55 to be rotated to any one of eight positions.

The condiment pump of the invention has several advantages over the prior art. The eccentric hole 59 in the washer plate 55 and the post 71 combine to allow chunky condiments to be pumped through the upper ball valve 45 without plugging the valve 45 or straining the condiment. The notches 63 on the washer plate 55 and the pin 67 allow the spout 61 to be rotated to eight different positions. The cylinder nut 19 and the spout nut 53 allow the pump to be easily disassembled for cleaning.

The invention has been shown only in the preferred embodiment. The invention is susceptible to various changes and modifications without departing from the scope of the invention.

I claim:

1. A condiment pump, comprising:
- a container;
- a cylinder extending downward into the container;
- a piston, within the cylinder;
- a piston rod connected to the piston, and extending above the top of the container;
- bias means for biasing the piston upward;
- a lower ball valve at the bottom of the cylinder;
- a side arm tube, extending from the lower ball valve to the top of the container;
- an upper ball valve, at the top of the side arm tube;
- a spout, extending upward from the side arm tube; and
- a washer plate, covering the upper end of the side arm tube, having a rim, a plurality of notches around the rim and an eccentrically located hole, the center of said hole being located at a distance from the side wall of said ball valve sufficient to keep the ball of the upper ball valve from blocking the hole.

2. A condiment pump, as recited in claim 1, further comprising:
- a pin extending upward from the upper ball valve to engage one of the notches.

3. A condiment pump, as recited in claim 2, wherein the pin allows the washer plate to be positioned at locations corresponding to the notches around the rim of the washer plate.

4. A condiment pump, comprising:
- a container;
- a cylinder extending downward into the container;
- a piston, within the cylinder;
- a piston rod connected to the piston, and extending above the top of the container;
- bias means for biasing the piston upward;
- a lower ball valve at the bottom of the cylinder;
- a side arm tube, extending from the lower ball valve to the top of the container;
- an upper ball valve, at the top of the side arm tube;
- a spout, extending upward from the side arm tube;
- a washer plate, covering the upper end of the side arm tube, having a rim, a plurality of notches around the rim and an eccentric hole; and
- a post, extending downward from the washer plate, to keep the ball of the upper ball valve at least a predetermined distance away from the hole to allow the passage of chunky condiments without plugging the ball valve or straining out the chunks.

5. A condiment pump, as recited in claim 4, further comprising:
- a pin extending upward from the upper ball valve to engage one of the notches.

6. A condiment pump, as recited in claim 5, wherein the pin allows the washer plate to be positioned at locations corresponding to the notches around the rim of the washer plate.

7. A condiment pump, comprising:
- a container;
- a lid on the container;
- a cylinder extending downward from the lid into the container;
- a piston, within the cylinder;
- a piston rod connected to the piston, and extending above the lid;
- bias means for biasing the piston upward;
- a lower ball valve at the bottom of the cylinder;
- a side arm tube, extending from the lower ball valve to the lid;
- an upper ball valve, at the top of the side arm tube;
- a spout, extending upward from the side arm tube;
- a washer plate, covering the upper end of the side arm tube, having a rim, a plurality of notches around the rim and an eccentric hole; and
- a post, extending downward from the washer plate, adjacent to the hole, to keep the ball of the upper ball valve at least a predetermined distance away from the hole to allow the passage of chunky condiments without plugging the ball valve or straining out the chunks.

8. A condiment pump, as recited in claim 7, further comprising:
- a pin extending upward from the upper ball valve to engage one of the notches.

9. A condiment pump, as recited in claim 8, wherein the pin allows the washer plate to be positioned at locations corresponding to the notches around the rim of the washer plate.

* * * * *